US006502551B2

(12) United States Patent
Antonioli et al.

(10) Patent No.: US 6,502,551 B2
(45) Date of Patent: Jan. 7, 2003

(54) METHOD OF ASSESSING OPERATION OF AN INTERNAL COMBUSTION ENGINE COMMON-RAIL INJECTION SYSTEM

(75) Inventors: Pierpaolo Antonioli, Piossasco (IT); Sara Sottano, Pinerolo (IT); Cristiana Davide, Turin (IT); Massimo Osella, Bruino (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 09/761,744

(22) Filed: Jan. 18, 2001

(65) Prior Publication Data

US 2001/0025626 A1 Oct. 4, 2001

(30) Foreign Application Priority Data

Jan. 18, 2000 (IT) ..... TO00A0045

(51) Int. Cl.[7] ..... F02M 41/00

(52) U.S. Cl. ..... 123/456; 123/198 D; 123/198 DB; 73/119 A

(58) Field of Search ..... 123/359, 446, 123/456, 479, 497, 198 D, 198 DB; 73/119 A

(56) References Cited

U.S. PATENT DOCUMENTS 5,020,362 A * 6/1991 Hart et al. ..... 73/119 A
5,445,019 A * 8/1995 Glidewell et al. ..... 73/119 A
5,493,902 A * 2/1996 Glidewell et al. ..... 73/119 A
5,633,458 A * 5/1997 Pauli et al. ..... 73/119 A

FOREIGN PATENT DOCUMENTS

| | | |
|---|---|---|
| DE | 195 13 158 | 10/1996 |
| DE | 197 27 794 | 1/1999 |
| EP | 0 785 349 | 7/1997 |
| EP | 0 785 358 | 7/1997 |
| EP | 0 786 593 | 7/1997 |
| EP | 0 886 056 | 12/1998 |
| EP | 0 974 826 | 1/2000 |
| JP | 10-89135 | 4/1998 |

* cited by examiner

*Primary Examiner*—Thomas N. Moulis
(74) *Attorney, Agent, or Firm*—Crowell & Moring LLP

(57) ABSTRACT

A method of assessing operation of a common-rail injection system of an internal combustion engine; the injection system having a number of injectors, a high-pressure circuit supplying high-pressure fuel to the injectors, and a low-pressure circuit supplying fuel to the high-pressure circuit; and the method including the steps of hydraulically isolating the high-pressure circuit from the low-pressure circuit and the engine; and assessing operation of the injection system as a function of the fuel pressure drop in the high-pressure circuit.

16 Claims, 4 Drawing Sheets

METHOD OF ASSESSING OPERATION OF AN INTERNAL COMBUSTION ENGINE COMMON-RAIL INJECTION SYSTEM

The present invention relates to a method of assessing operation of an internal combustion engine common-rail injection system.

BACKGROUND OF THE INVENTION

As is known, of the various problems that can occur in a common-rail injection system, the worst and most dangerous are leakage of the high-pressure circuit, which results in fuel leakage in the form of a very fine spray, and one or more of the injectors jamming in the open position.

On the one hand, high-pressure fuel leakage may cause a fire if the fuel spray should strike particularly hot engine surfaces; and, on the other, a jammed-open injector results in continuous fuel supply to the cylinders, in turn resulting, not only in excessive fuel consumption, but also in abnormal combustion characterized by pressure peaks and a considerable temperature increase in the cylinders.

Such defects can only be tolerated so long without causing serious damage to the engine, e.g. to the connecting rod, piston or injector nozzles, and may immediately impair operation and the safety of the vehicle.

To prevent this from happening, diagnostic units were proposed for detecting hazardous situations and which act on the injection system to immediately cut off fuel supply to the injectors and so immediately stop the engine.

In common-rail injection systems, however, the low-pressure circuit is also subject to fuel leakage caused, for example, by fine cracks in the low-pressure conduits or by faulty low-pressure circuit parts. Such leakage, however, is not as serious as that caused by fuel spray or a jammed-open injector, by not immediately impairing operation and the safety of the vehicle, which, in these cases, in fact, can safely be driven at least to the nearest repair shop.

Known diagnostic units, however, were unable to discriminate between high-pressure circuit fuel leakage caused, for example, by a jammed-open injector, and low-pressure circuit leakage caused by a generic fault in the low-pressure circuit. As a result, even in the case of minor nonhazardous faults in the low-pressure circuit, known diagnostic units immediately disabled the vehicle, thus causing considerable inconvenience to the driver, out of all proportion to the immediate danger involved.

Diagnostic units have therefore recently been proposed, designed to discriminate between injection system fuel leakage caused by a jammed-open injector, and leakage caused by a generic fault in the injection system.

The Applicant's European Patent Application EP-0785349, for example, describes a diagnostic unit for determining a jammed-open injector condition using, among other things, an accelerometer signal related to the intensity of vibration on the engine and generated by an accelerometer sensor on the engine block. More specifically, the diagnostic unit compares the amplitude of the accelerometer signal with a first reference value; compares with a second reference value the engine angle value at which the amplitude of the accelerometer signal exceeds the first reference value; and determines a jammed-open injector condition according to the outcome of the two comparisons.

The Applicant's European Patent Application EP-0786593, on the other hand, describes a fuel catch structure for determining leakage from the injector fuel supply conduits. More specifically, the structure comprises a number of sleeves made of elastomeric material, surrounding the injector supply conduits, and for catching any fuel leaking from the conduits; a catch header connected to the sleeves and for receiving any fuel leaking from the conduits and conveyed by the sleeves; a fluid sensor located beneath the catch header and for generating a leak signal indicating the presence of fuel in the catch header; and an alarm circuit connected to the fluid sensor and for generating an alarm signal when the catch header contains fuel.

While affording numerous advantages, particularly as regards efficient detection of the above fuel leakage conditions, both the solutions described have one drawback preventing their advantages from being fully exploited.

That is, both conditions—fuel leakage caused by a jammed-open injector and fuel leakage from the supply conduits—are determined using additional dedicated elements nor normally provided on the vehicle, such as an accelerometer sensor and the catch structure described above, which, besides costing money to manufacture or purchase and assemble, also call for periodic maintenance.

SUMMARY OF THE INVENTION

It is therefore an object of the present invention to provide a method of assessing operation of a common-rail injection system, and which provides, in a straightforward, low-cost manner, for discriminating between high-pressure circuit fuel leakage and leakage caused by a generic fault in the low-pressure circuit, with no need for additional elements other than those already provided on the vehicle.

According to the present invention, there is provided a method of assessing operation of a common-rail injection system of an internal combustion engine; said injection system comprising a number of injectors, a high-pressure circuit supplying high-pressure fuel to said injectors, and a low-pressure circuit supplying fuel to said high-pressure circuit; characterized by comprising the steps of:

hydraulically isolating said high-pressure circuit from said low-pressure circuit and said engine; and assessing operation of said injection system as a function of the fuel pressure drop in said high-pressure circuit.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
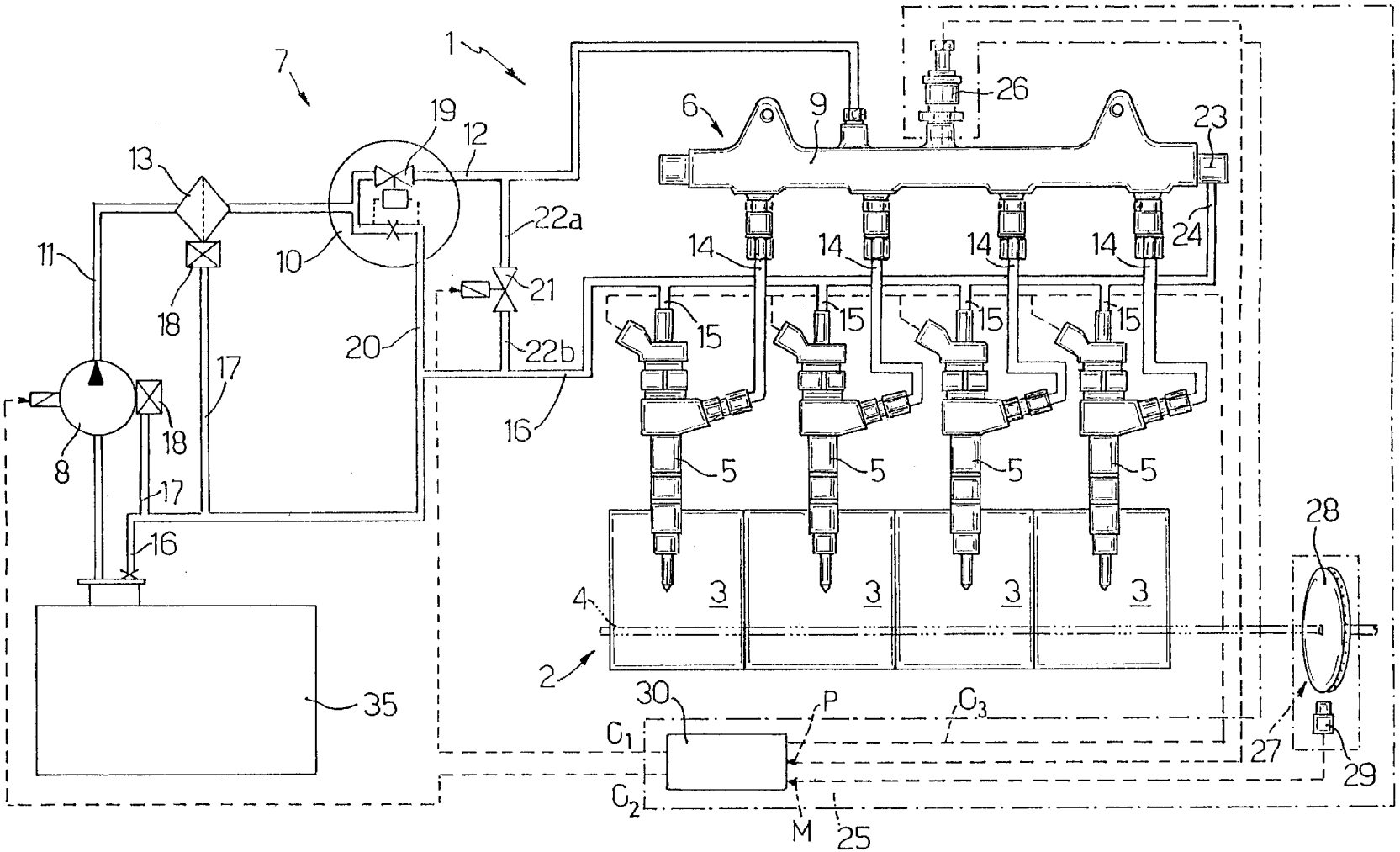
FIG. 1 shows a simplified diagram of a common-rail injection system.

Number 1 in FIG. 1 indicates as a whole a common-rail injection system for an internal combustion engine, in particular a diesel engine, 2 comprising a number of cylinders 3 and an output shaft 4 (shown schematically by the dot-and-dash line).

Injection system 1 substantially comprises a number of injectors 5 supplying high-pressure fuel to cylinders 3 of engine 2; a high-pressure circuit 6 supplying high-pressure fuel to injectors 5; and a low-pressure circuit 7 supplying fuel to high-pressure circuit 6.

Low-pressure circuit 7 comprises a fuel tank 35; a supply pump 8, e.g. electric, connected to tank 35; a high-pressure pump 10 connected to supply pump 8 by a low-pressure supply line 11; and a fuel filter 13 located along low-pressure supply line 11, between supply pump 8 and high-pressure pump 10.

High-pressure circuit 6 comprises a known common rail 9 connected by a high-pressure supply line 12 to high-pressure pump 10, and by respective high-pressure supply conduits 14 to injectors 5, which are also connected by respective recirculating conduits 15 to a drain line 16, in turn connected to tank 35 to feed back into tank 35 part of the fuel used in known manner by and for operation of injectors 5.

Drain line 16 is also connected to high-pressure pump 10 by a respective recirculating conduit 20, and to supply pump 8 and fuel filter 13 by respective recirculating conduits 17 and respective overpressure valves 18.

High-pressure pump 10 is fitted with an on/off, so-called shut-off, valve 19 (shown schematically) for permitting supply to the pumping elements (not shown) of high-pressure pump 10 when a difference in pressure exists between low-pressure supply line 11 and recirculating conduit 20.

High-pressure circuit 6 also comprises a pressure regulator 21 connected between high-pressure supply line 12 and drain line 16 by a supply conduit 22*a* and a recirculating conduit 22*b* respectively. When activated, regulator 21 provides for feeding back into tank 35 part of the fuel supplied by high-pressure pump 10 to common rail 9, so as to regulate, in known manner not described in detail, the pressure of the fuel supplied by high-pressure pump 10, and hence the pressure of the fuel in common rail 9.

High-pressure circuit 6 also comprises a pressure relief device 23 connected on one side to common rail 9 and on the other side by a recirculating conduit 24 to drain line 16, and which prevents the pressure of the fuel in common rail 9 from exceeding a predetermined maximum value.

Injection system 1 also comprises a diagnostic unit 25 for detecting and diagnosing leakage in injection system 1.

Diagnostic unit 25 comprises a pressure sensor 26 connected to common rail 9 and generating a pressure signal P correlated to the pressure of the fuel in common rail 9 and therefore to the fuel injection pressure; and a detecting device 27 for detecting the speed and angular position of output shaft 4, and in turn comprising a known sound wheel 28 fitted to output shaft 4, and an electromagnetic sensor 29 associated with sound wheel 28 and generating a movement signal M correlated to the speed and angular position of sound wheel 28 and therefore to the speed and angular position of output shaft 4.

Figure 2:
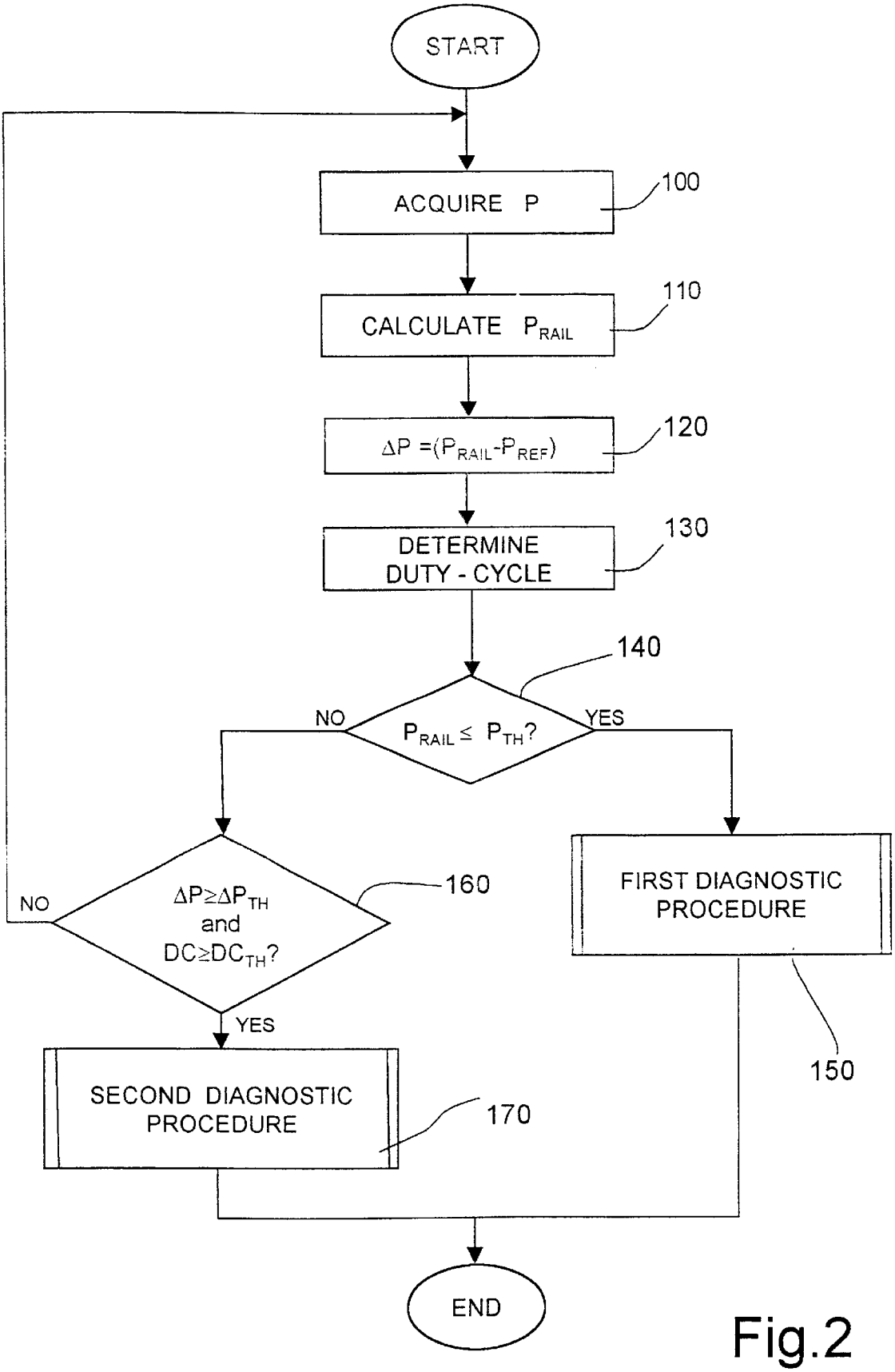
FIGS. 2, 3 and 4 show flow charts illustrating the assessment method according to the present invention.

Diagnostic unit 25 also comprises an electronic central control unit 30 (forming part, for example, of a central engine control unit not shown) for controlling injection system 1, and which receives pressure and movement signals P and M, and generates a first control signal C supplied to pressure regulator 21, a second control signal $C_2$ supplied to supply pump 8, and a third control signal $C_3$ supplied to injectors 5, by implementing the operations described with reference to FIG. 2 to:

determine a possible leakage condition in injection system 1;

determine whether the leakage condition is due to leakage in high-pressure circuit 6 caused, for example, by one or more jammed-open injectors or by a crack in the high-pressure conduits, or is due to a generic fault in low-pressure circuit 7; and act appropriately on injection system 1 according to the type of leakage diagnosed.

More specifically, as shown in FIG. 2, electronic central control unit 30 continuously acquires pressure signal P (block 100) and accordingly determines, instant by instant, the instantaneous pressure value $P_{RAIL}$ of the fuel in common rail 9 (block 110).

Electronic central control unit also determines a pressure error ΔP equal to the absolute value of the difference between instantaneous pressure value $P_{RAIL}$ and a reference pressure value $P_{REF}$ (block 120), i.e. $\Delta P=|P_{RAIL}-P_{REF}|$.

More specifically, reference pressure value $P_{REF}$ is what the pressure value in common rail 9 should be to achieve the performance required by the driver, i.e. represents the target of the closed-loop control regulating the pressure in common rail 9.

Electronic central control unit 30 then determines the duty cycle DC of first control signal $C_1$, supplied to pressure regulator 21 (block 130) to achieve the pressure conditions ($P_{REF}$) required of injection system 1. Duty cycle DC values above the normal range indicate injection system 1 is having difficulty achieving the required injection pressure ($P_{REF}$).

Electronic central control unit 30 then compares instantaneous pressure value $P_{RAIL}$ with a threshold pressure value $P_{TH}$ (block 140), which is calculated according to the speed of engine 2 and represents a minimum permissible pressure value, e.g. 120–200 bar, below which injection system 1 is definitely malfunctioning and calls for a procedure to determine the cause.

If instantaneous pressure value $P_{RAIL}$ is less than or equal to threshold pressure value $P_{TH}$ (YES output of block 140), electronic central control unit 30 diagnoses faults in injection system 1 and performs a first diagnostic procedure—described in detail later on with reference to FIG. 3—to determine whether the faults are due to a jammed-open injector, to fuel leakage in high-pressure circuit 6, or to a generic fault in low-pressure circuit 7 (block 150).

Conversely, if instantaneous pressure value $P_{RAIL}$ is greater than threshold pressure value $P_{TH}$ (NO output of block 140), electronic central control unit 30 compares pressure error ΔP with a threshold pressure error $\Delta P_{TH}$ representing a maximum permissible pressure error, e.g. 250 bar, above which injection system 1 is definitely malfunctioning, and compares duty cycle DC with a threshold duty cycle value $DC_{TH}$, e.g. of 95% (block 160).

If pressure error ΔP is greater than or equal to threshold pressure error $\Delta P_{TH}$, and duty cycle DC is greater than or equal to threshold duty cycle value $DC_{TH}$ (YES output of block 160), electronic central control unit 30 diagnoses faults in injection system 1, and performs a second diagnostic procedure—described in detail later on with reference to FIG. 4—to determine whether the faults are due to a jammed-open injector, to fuel leakage in high-pressure circuit 6, or to a generic fault in low-pressure circuit 7 (block 170).

Conversely, if pressure error ΔP is less than threshold pressure error $\Delta P_{TH}$, or duty cycle DC is less than threshold duty cycle value $DC_{TH}$ (NO output of block 160), electronic central control unit 30 diagnoses no faults in injection system 1, and operation continues once more from block 100.

Figure 3:
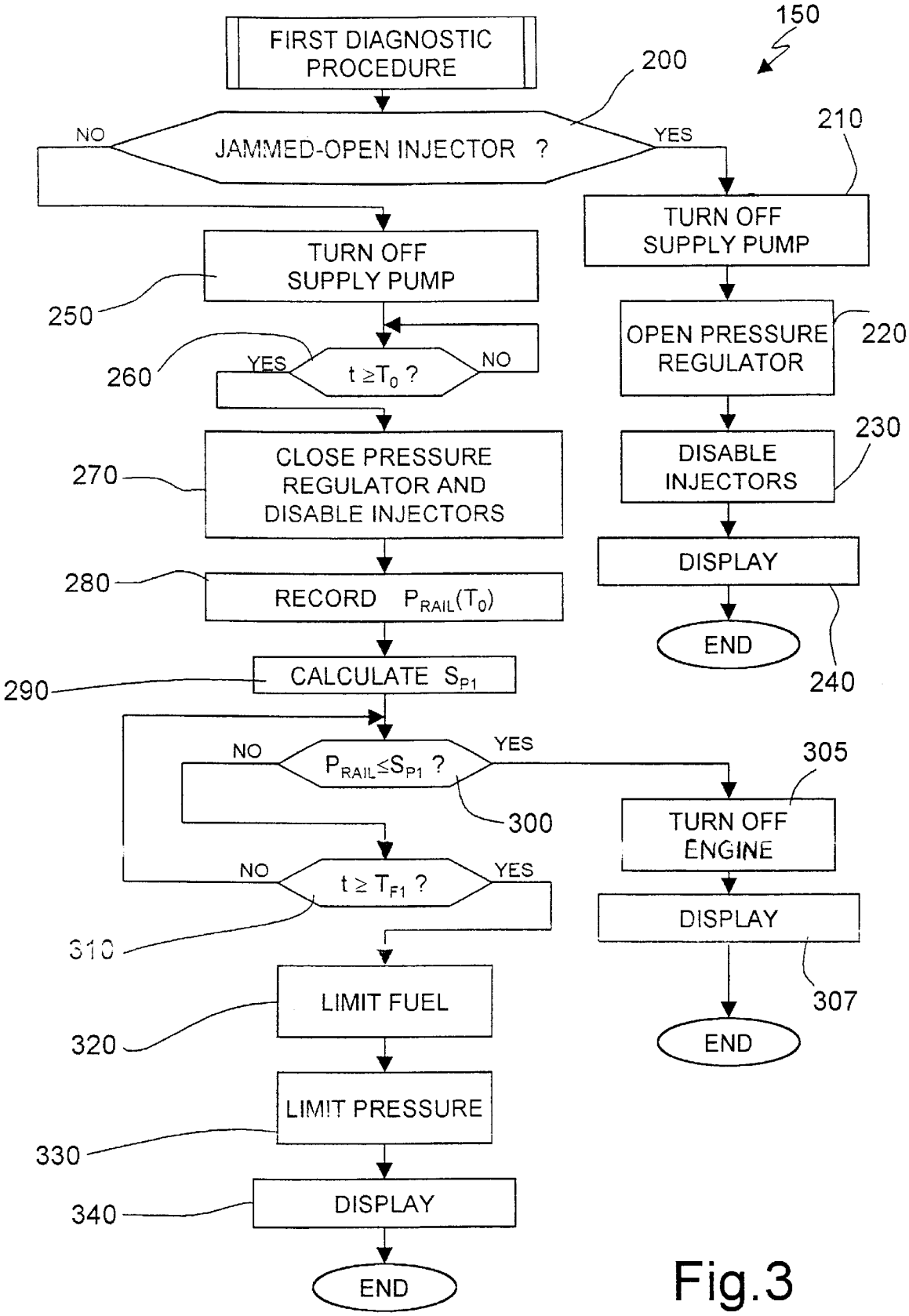

As shown in FIG. 3, in the first diagnostic procedure, which is performed when instantaneous pressure value $P_{RAIL}$ is less than or equal to threshold value $P_{TH}$, electronic central control unit 30 first determines whether the fuel leakage in injection system 1 is caused by one or more jammed-open injectors (block 200).

More specifically, whether or not any of the injectors are jammed open is determined using the method described in detail in the European Patent Application EP-0785358, which, briefly, provides for reducing the quantity of fuel injected into cylinders 3, e.g. by completely disabling the injectors; calculating the value of the useful torque $C_U$ generated by engine 2; comparing the useful torque value $C_U$ with a reference value $C_T$; and determining, according to the outcome of the comparison, whether the leakage in injection system 1 is caused or not by one or more jammed-open injectors.

More specifically, a jammed-open injector condition is diagnosed when the useful torque value $C_u$, is greater than reference value $C_T$; otherwise, a generic injection system 1 fault condition is diagnosed.

That is, if the fuel leakage is not caused by a jammed-open injector, reducing the quantity of fuel injected into cylinders 3 produces a predetermined reduction in the contribution of each cylinder 3 to the useful torque value, which reduction is a function of the amount by which the quantity of fuel injected is reduced. Conversely, if the fuel leakage is caused by a jammed-open injector, this results in continuous fuel supply to the respective cylinder, so that there is no reduction in the contribution of that cylinder to the value of the useful torque generated by engine 2.

Therefore, by determining whether the reduction in the contribution of each cylinder to the useful torque generated by the engine is a function of the reduction in the amount of fuel injected, it is possible to determine not only that an injector, but also which injector, is jammed in the open position.

With reference to block 200, if the presence of one or more jammed-open injectors is diagnosed (YES output of block 200), electronic central control unit 30 disables supply pump 8 to cut off fuel supply to injectors 5 (block 210), fully opens pressure regulator 21 to drain the fuel from common rail 9 (block 220), and disables all of injectors 5 (if they are not already) to cut off fuel injection into cylinders 3 (block 230), thus turning off engine 2.

Electronic central control unit 30 then indicates the type of leakage detected by means of on-vehicle display or acoustic indicator devices (block 240).

Conversely, if no jammed-open injectors are diagnosed (NO output of block 200), electronic central control unit 30 performs a series of operations—described below with reference to blocks 250–340—to determine the type of fault responsible for the malfunctioning of injection system 1, and in particular whether the malfunction is caused by leakage in high-pressure circuit 6 or by a fault in low-pressure circuit 7.

More specifically, electronic central control unit 30 turns off supply pump 8 (block 250) and switches to standby for a time $T_0$ long enough for supply pump 8 to turn off completely, and for shut-off valve 19 of high-pressure pump 10 to close completely (block 260).

At this point, electronic central control unit 30 closes pressure regulator 21 and cuts off fuel supply by injectors 5 so as to isolate common rail 9 hydraulically from the rest of the injection system, except for inevitable leakage in injectors 5, pressure regulator 21 and high-pressure pump 10 (block 270).

Once injection system 1 is completely isolated hydraulically, electronic central control unit 30 performs a series of operations—described in detail below with reference to blocks 280–310—to determine whether, in a predetermined time interval $T_{Fl}$ of, say, 500 ms, the fuel pressure in common rail 9 falls relatively quickly—indicating a fault in high-pressure circuit 6, e.g. a crack in the high-pressure conduits or the fuel pressure falls relatively slowly—indicating a fault in the low-pressure circuit of injection system 1.

To determine the above fall in fuel pressure, electronic central control unit 30, at the end of standby time $T_0$, records the pressure value $P_{RAIL}(T_0)$ in common rail 9 (block 280) and calculates, as a function of pressure value $P_{RAIL}(T_0)$, a limit pressure value $S_{P1}$, e.g. about 50 bars lower than pressure value $P_{RAIL}(T_0)$ (block 290), which is used to distinguish the type of fault in injection system 1, and which takes into account, among other things, the part played in the pressure drop by leakage in pressure regulator 21, injectors 5 and high-pressure pump 10.

More specifically, to assess the speed at which the fuel pressure in common rail 9 falls, electronic central control unit 30 determines whether the instantaneous pressure value $P_{RAIL}$ of the fuel in common rail 9 is less than or equal to said limit pressure value $S_{P1}$ (block 300).

If the instantaneous pressure value $P_{RAIL}$ is less than or equal to limit pressure value $S_{P1}$ (YES output of block 300), electronic central control unit 30 diagnoses a fault in high-pressure circuit 6 caused by a fuel leak outside cylinders 3—due, for example, to a crack in supply conduits 14, faulty sealing on pressure regulator 21, or faulty sealing on a nonreturn valve (not shown) of high-pressure pump 10, etc.—and therefore fully opens pressure regulator 21 to turn off engine 2 (block 305).

Electronic central control unit 30 then indicates the type of leakage detected by means of on-vehicle display or acoustic indicator devices (block 307).

Conversely, if the instantaneous pressure value $P_{RAIL}$ is greater than limit pressure value $S_{P1}$ (NO output of block 300), electronic central control unit 30 determines whether time $T_{F1}$ has elapsed since it started the block 300 check (block 310)

If time $T_{F1}$ has not elapsed (NO output of block 310), electronic central control unit 30 performs the block 300 check again. Conversely, if time $T_{F1}$ has elapsed (YES output of block 310), electronic central control unit 30 diagnoses a fault in low-pressure circuit 7—caused, for example, by a fault on high-pressure pump 10, supply pump 8 or overpressure valve 18 of fuel filter 13, by clogging of fuel filter 13, lack of fuel in tank 35, or leakage along low-pressure supply line 11, etc.—and therefore limits engine performance by limiting the maximum amount of fuel injectable into each cylinder 3 (block 320) and the maximum permissible fuel pressure in common rail 9 (block 330).

Electronic central control unit 30 then indicates the type of leakage detected by. means of on-vehicle display or acoustic indicator devices (block 340).

Figure 4:
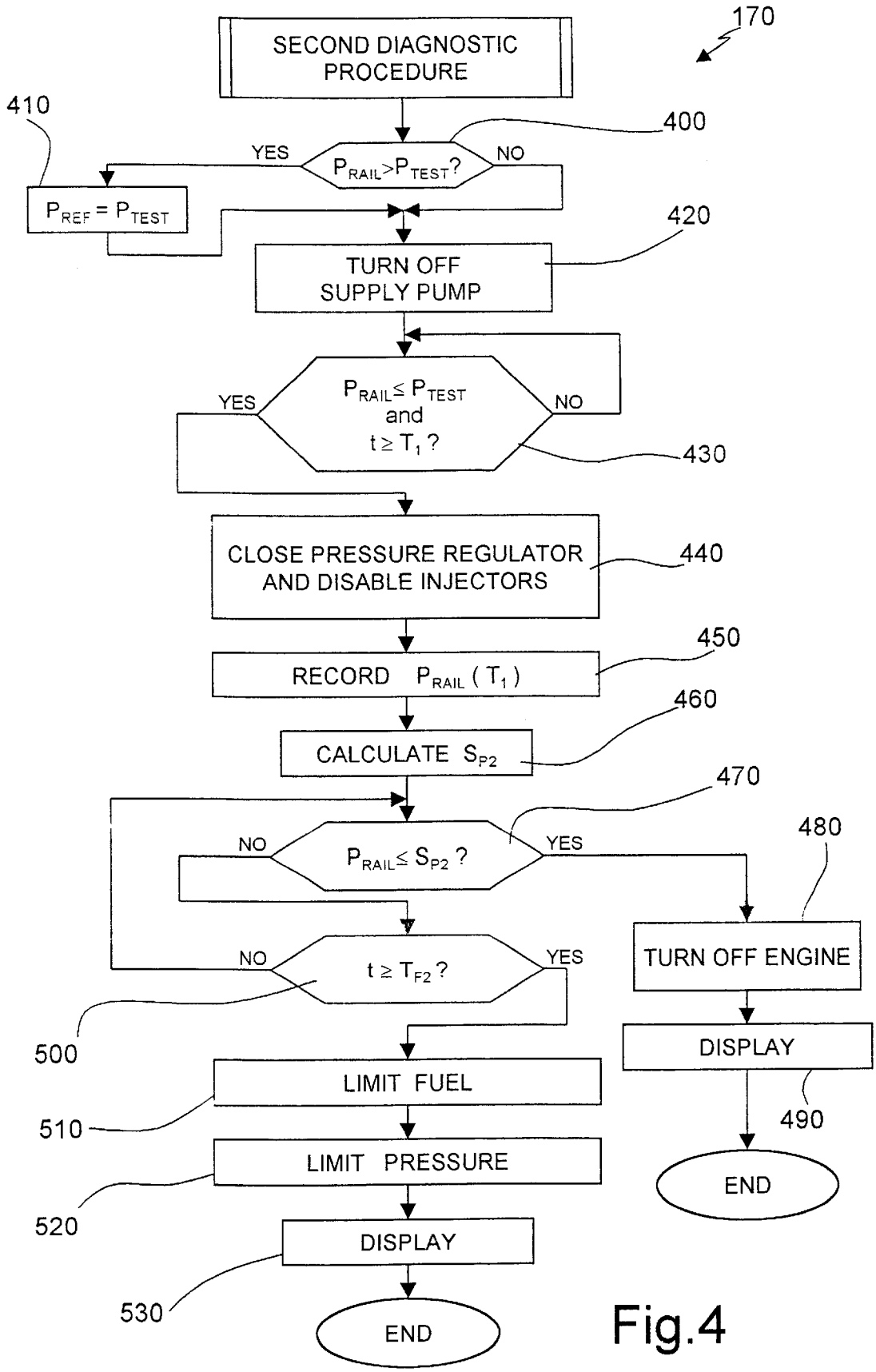

As shown in FIG. 4, in the second diagnostic procedure, which is performed when pressure error $\Delta P$ is greater than or equal to threshold pressure error $\Delta P_{TH}$, and duty cycle DC is greater than or equal to threshold duty cycle $DC_{TH}$, electronic central control unit 30 first compares instantaneous pressure value $P_{RAIL}$ with a predetermined test pressure value $P_{TEST}$, e.g. of 400 bar (block 400).

If instantaneous pressure value $P_{RAIL}$ is greater than test pressure value $P_{TEST}$ (YES output of block 400), electronic central control unit 30 imposes that reference pressure value $P_{REF}$—which is the target of the closed-loop control regulating the pressure in common rail 9—be equal to test pressure value $P_{TEST}$ (block 410), and then disables supply pump 8 (block 420). Conversely, if instantaneous pressure value $P_{RAIL}$ is less than or equal to test pressure value $P_{TEST}$ (No output of block 400), electronic central control unit 30 simply disables supply pump 8 (block 420).

Electronic central control unit 30 then switches to standby for a time $T_1$, in which it continues to determine whether instantaneous pressure value $P_{RAIL}$ is less than or equal to test pressure value $P_{TEST}$ (block 430). In this case, too, time $T_1$ is long enough for supply pump 8 to turn off completely and therefore for shut-off valve 19 of high-pressure pump 10 to close completely.

As long as instantaneous pressure value $P_{RAIL}$ is greater than test pressure value $P_{TEST}$, or time $T_1$, has not yet elapsed (NO output of block 430), electronic central control unit 30 continues checking instantaneous pressure value $P_{RAIL}$; conversely, when instantaneous pressure value $P_{RAIL}$ is less than or equal to test pressure value $P_{TEST}$ and time $T_1$ has elapsed (YES output of block 430), electronic central control unit 30 closes pressure regulator 21 and disables injectors 5 to isolate common rail 9 hydraulically, except for inevitable leakage in injectors 5, pressure regulator 21 and high-pressure pump 10 (block 440).

Once injection system 1 is completely isolated hydraulically, electronic central control unit 30 performs a series of operations—described in detail below with reference to blocks 450–500—to determine whether, in a predetermined time interval $T_{F2}$ of, say, 500 ms, the fuel pressure in common rail 9 falls relatively quickly—indicating a fault in high-pressure circuit 6, e.g. a jammed-open injector or leakage outside cylinders 3—or the fuel pressure falls relatively slowly—indicating a fault in low-pressure circuit 7

More specifically, electronic central control unit 30 records the pressure value $P_{RAIL}$ $(T_1)$ in common rail 9 (block 450) and calculates, as a function of pressure value $P_{RAIL}(T_1)$, a limit pressure value $S_{P2}$, e.g. about 50 bars lower than pressure value $P_{RAIL}(T_1)$ (block 460), which is used to distinguish the type of fault in injection system 1, and which takes into account, among other things, the part played in the pressure drop by leakage in pressure regulator 21, injectors 5 and high-pressure pump 10.

More specifically, to assess the speed at which the fuel pressure in common rail 9 falls, electronic central control unit 30 determines whether the instantaneous pressure value $P_{RAIL}$ of the fuel in common rail 9 is less than or equal to said limit pressure value $S_{P3}$ (block 470).

If the instantaneous pressure value $P_{RAIL}$ is less than or equal to limit pressure value $S_{P2}$ (YES output of block 470), electronic central control unit 30 diagnoses a fault in high-pressure circuit 6 caused, for example, by a jammed-open injector or by a leak outside cylinders 3—due, for example, to a crack in supply conduits 14, faulty sealing on pressure regulator 21, faulty sealing on a nonreturn valve (not shown) of high-pressure pump 10, high recirculation in injectors 5, etc.—and therefore fully opens pressure regulator 21 to turn off engine 2 (block 480).

Electronic central control unit 30 then indicates the type of leakage detected by means of on-vehicle display or acoustic indicator devices (block 490).

Conversely, if the instantaneous pressure value $P_{RAIL}$ is greater than limit pressure value $S_{F2}$ (NO output of block 470), electronic central control unit 30 determines whether a time $T_{F2}$ has elapsed since it started the block 470 check (block 500).

If time $T_{F2}$ has not elapsed (NO output of block 500), electronic central control unit 30 performs the block 470 check again. Conversely, if time $T_{F2}$ has elapsed (YES output of block 500), electronic central control unit 30 diagnoses a fault in the low-pressure circuit of injection system 1—caused, for example, by a fault on high-pressure pump 10, insufficient supply by supply pump 8, a fault on overpressure valve 18 of fuel filter 13, clogging of fuel filter 13, lack of fuel in tank 35, or leakage along low-pressure supply line 11, etc.—and therefore limits engine performance by limiting the maximum amount of fuel injectable into each cylinder 3 (block 510) and the maximum permissible fuel pressure in common rail 9 (block 520).

Electronic central control unit 30 then indicates the type of leakage detected by means of on-vehicle display or acoustic indicator devices (block 530).

The advantages of the assessment method according to the present invention will be clear from the foregoing description.

In particular, unlike known methods, the method according to the invention provides for distinguishing the type of fault responsible for the fall in fuel pressure or the pressure error between the actual fuel pressure and the closed-loop control reference pressure, even when the fault is not due to a jammed-open injector.

The present invention may be used not only during operation of the vehicle to determine the type of fault responsible for the fall in injection pressure, but also, for example, each time the engine is turned off, so as to generate an injection system aging index, which may be used to inform the vehicle owner of the need to service the system, or as a means of classifying the injection system at the end of the vehicle production line.

More specifically, each time the engine is turned off, or at the end of the production line, electronic central control unit 30 may perform the steps described above to turn off supply pump 8, close pressure regulator 21, disable injectors 5 to isolate common rail 9 hydraulically from the rest of injection system 1, and determine the fall in pressure in common rail 9.

If the above steps are performed at the end of the vehicle production line, the determined pressure drop value may be used as a basis by which to classify the injection system. That is, a system with a relatively small pressure drop will be rated as excellent, while one with a severe pressure drop will be rated as poor and therefore rejected.

Conversely, if the above steps are performed each time the engine is turned off, the pressure drop value determined each time is used to generate an injection system aging index, e.g. an index which is a weighted average of the last determined pressure drop value and the previously memorized pressure drop value, which in turn is a weighted average obtained from yet another previous pressure drop value, and so on.

When the aging index exceeds a predetermined threshold value, a straightforward signal on the instrument panel may inform the user that the system has seriously deteriorated and requires servicing, or the same information may be stored in the central control unit and read at the first opportunity by the technician servicing the vehicle.

To avoid erroneous aging signals or erroneous end-of-line ratings due, for example, to factors occasionally affecting the injection system, provision may be made for confirming the rating or aging index, i.e. by only indicating rejection or the need for servicing the injection system when serious pressure drop values are detected several, e.g. at least three, times.

Clearly, changes may be made to the method as described and illustrated herein without, however, departing from the scope of the present invention.

What is claimed is:

1. A method of assessing operation of a common-rail injection system of an internal combustion engine; said injection system comprising a number of injectors, a high-pressure circuit supplying high-pressure fuel to said injectors, and a low-pressure circuit supplying fuel to said high-pressure circuit; the method comprising the steps of:

hydraulically isolating said high-pressure circuit from said low-pressure circuit and said engine; and assessing operation of said injection system as a function of the fuel pressure drop in said high-pressure circuit.

2. A method as claimed in claim 1, wherein said step of hydraulically isolating said high-pressure circuit from said low-pressure circuit and said engine comprises the steps of:

cutting off fuel supply from said low-pressure circuit to said high-pressure circuit; and cutting off fuel supply from said injectors to said engine.

3. A method as claimed in claim 1, wherein said step of assessing operation of said injection system comprises the steps of:

determining the fuel pressure drop in said high-pressure circuit;

comparing said determined pressure drop with a reference pressure drop;

determining a fault in said high-pressure circuit when a first predetermined relationship exists between said determined pressure drop and said reference pressure drop; and determining a fault in said low-pressure circuit in the absence of said first predetermined relationship between said determined pressure drop and said reference pressure drop.

4. A method as claimed in claim 3, wherein said first predetermined relationship is defined by the condition that said determined pressure drop be greater than said reference pressure drop.

5. A method of assessing operation of a common-rail injection system of an internal combustion engine; said injection system comprising a number of injectors, a high-pressure circuit supplying high-pressure fuel to said injectors, and a low-pressure circuit supplying fuel to said high-pressure circuit; the method comprising the steps of:

hydraulically isolating said high-pressure circuit from said low-pressure circuit and said engine;

assessing operation of said injection system as a function of the fuel pressure drop in said high-pressure circuit; and wherein said step of assessing operation of said injection system comprises the steps of:

determining the fuel pressure drop in said high-pressure circuit;

comparing said determined pressure drop with a reference pressure drop;

determining a fault in said high-pressure circuit when a first predetermined relationship exists between said determined pressure drop and said reference pressure drop;

determining a fault in said low-pressure circuit in the absence of said first predetermined relationship between said determined pressure drop and said reference pressure drop;

determining a limit pressure value;

comparing the instantaneous pressure value of the fuel in said high-pressure circuit with said limit pressure value for a predetermined time interval;

determining said fault in said low-pressure circuit when a second predetermined relationship exists between said instantaneous pressure value and said limit pressure value throughout said time interval; and determining said fault in said high-pressure circuit in the absence of said second predetermined relationship between said instantaneous pressure value and said limit pressure value during said time interval.

6. A method as claimed in claim 5, wherein said second predetermined relationship is defined by the condition that said instantaneous pressure value be greater than said limit pressure value throughout said time interval.

7. A method as claimed in claim 5, wherein said step of determining a limit pressure value comprises the step of:

determining said limit pressure value as a function of the instantaneous pressure value of said fuel in said high-pressure circuit.

8. A method of assessing operation of a common-rail injection system of an internal combustion engine; said injection system comprising a number of injectors, a high-pressure circuit supplying high-pressure fuel to said injectors, and a low-pressure circuit supplying fuel to said high-pressure circuit; the method comprising the steps of:

hydraulically isolating said high-pressure circuit from said low-pressure circuit and said engine;

assessing operation of said injection system as a function of the fuel pressure drop in said high-pressure circuit;

wherein said step of assessing operation of said injection system comprises the steps of:

determining the fuel pressure drop in said high-pressure circuit;

comparing said determined pressure drop with a reference pressure drop;

determining a fault in said high-pressure circuit when a first predetermined relationship exists between said determined pressure drop and said reference pressure drop;

determining a fault in said low-pressure circuit in the absence of said first predetermined relationship between said determined pressure drop and said reference pressure drop;

the method further comprising the steps of:

turning off said engine in the event said fault in said high-pressure circuit is determined; and limiting the performance of said engine in the event said fault condition in said low-pressure circuit is determined.

9. A method as claimed in claim 8, wherein said step of limiting the performance of said engine comprises the steps of:

limiting the maximum fuel quantity injectable by said injectors; and limiting the maximum permissible pressure of said fuel in said high-pressure circuit.

10. A method of assessing operation of a common-rail injection system of an internal combustion engine; said injection system comprising a number of injectors, a high-pressure circuit supplying high-pressure fuel to said injectors, and a low-pressure circuit supplying fuel to said high-pressure circuit; the method comprising the steps of:

hydraulically isolating said high-pressure circuit from said low-pressure circuit and said engine;

assessing operation of said injection system as a function of the fuel pressure drop in said high-pressure circuit; and wherein said step of assessing operation of said injection system comprises the steps of:

determining the fuel pressure drop in said injection system; and classifying said injection system as a function of said determined pressure drop.

11. A method of assessing operation of a common-rail injection system of an internal combustion engine; said injection system comprising a number of injectors, a high-pressure circuit supplying high-pressure fuel to said injectors, and a low-pressure circuit supplying fuel to said high-pressure circuit; the method comprising the steps of:

hydraulically isolating said high-pressure circuit from said low-pressure circuit and said engine;

assessing operation of said injection system as a function of the fuel pressure drop in said high-pressure circuit; and wherein said step of assessing operation of said injection system comprises the steps of:

determining the fuel pressure drop in said high- pressure circuit;

generating an aging index of said injection system as a function of said determined pressure drop.

12. A method as claimed in claim 11, further comprising the step of periodically repeating said step of determining the fuel pressure drop in said high-pressure circuit and said step of generating an aging index of said injection system as a function of said determined pressure drop; said I aging index being calculated as a function of the pressure drops determined.

13. A method as claimed in claim 12, wherein said aging index is calculated, at each determination, as a moving mean of the determined pressure drop value and a previous pressure drop value.

14. A method of assessing operation of a common-rail injection system of an internal combustion engine; said injection system comprising a number of injectors, a high-pressure circuit supplying high-pressure fuel to said injectors, and a low-pressure circuit supplying fuel to said high-pressure circuit; the method comprising the steps of:

hydraulically isolating said high-pressure circuit from said low-pressure circuit and said engine;

assessing operation of said injection system as a function of the fuel pressure drop in said high-pressure circuit; and wherein said high-pressure circuit comprises a common rail connected to said injectors and to said low-pressure circuit by high-pressure conduits, and wherein said step of hydraulically isolating said high-pressure circuit comprises the step of:

hydraulically isolating said common rail and said high-pressure conduits.

15. A method as claimed in claim 14, wherein said low-pressure circuit comprises a supply pump for drawing fuel from a tank, a high-pressure pump connected to said supply pump and to said common rail, and a pressure regulator for regulating the fuel pressure in said high-pressure circuit, characterized in that said step of hydraulically isolating said high-pressure circuit from said low-pressure circuit and said engine comprises the steps of:

disabling said supply pump;

closing said pressure regulator; and cutting off injection by said injectors.

16. A method of assessing operation of a common-rail injection system of an internal combustion engine; said injection system comprising a number of injectors, a high-pressure circuit supplying high-pressure fuel to said injectors, and a low-pressure circuit supplying fuel to said high-pressure circuit; the method comprising the steps of:

hydraulically isolating said high-pressure circuit from said low-pressure circuit and said engine;

assessing operation of said injection system as a function of the fuel pressure drop in said high-pressure circuit;

determining the presence of a jammed-open injector condition;

turning off said engine if said jammed-open injector condition is determined; and performing said step of hydraulically isolating said high-pressure circuit and said step of assessing operation of said injection system if said jammed-open injector condition is not determined.

* * * * *